US007472905B2

(12) United States Patent
Inoue

(10) Patent No.: US 7,472,905 B2
(45) Date of Patent: Jan. 6, 2009

(54) SHEET CONVEYING APPARATUS, IMAGE FORMING APPARATUS AND IMAGE READING APPARATUS

(75) Inventor: Hiroshige Inoue, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 339 days.

(21) Appl. No.: 11/182,747

(22) Filed: Jul. 18, 2005

(65) Prior Publication Data

US 2006/0017214 A1 Jan. 26, 2006

(30) Foreign Application Priority Data

Jul. 20, 2004 (JP) ..... 2004-211694

(51) Int. Cl.
*B65H 7/02* (2006.01)
*G03G 15/00* (2006.01)

(52) U.S. Cl. ..... 271/227; 271/228; 399/372; 399/395

(58) Field of Classification Search ..... 271/227, 271/228

See application file for complete search history.

(56) References Cited

U.S. PATENT DOCUMENTS

| | | | | |
|---|---|---|---|---|
| 5,034,781 | A * | 7/1991 | Watanabe | 399/395 |
| 5,055,756 | A | 10/1991 | Ohkoda et al. | 318/618 |
| 5,219,159 | A * | 6/1993 | Malachowski et al. | 271/228 |
| 5,358,230 | A | 10/1994 | Ikemori et al. | 271/114 |
| 5,485,991 | A | 1/1996 | Hirano et al. | 271/121 |
| 5,676,477 | A * | 10/1997 | Tanaka et al. | 400/579 |
| 5,793,399 | A | 8/1998 | Kawakami et al. | 347/104 |
| 5,867,196 | A | 2/1999 | Kiyohara et al. | 347/104 |
| 5,886,729 | A | 3/1999 | Hiramatsu et al. | 347/264 |
| 5,899,451 | A | 5/1999 | Kiyohara et al. | 271/167 |
| 5,992,993 | A | 11/1999 | Kiyohara et al. | 347/104 |
| 6,045,220 | A | 4/2000 | Kiyohara et al. | 347/104 |
| 6,059,285 | A * | 5/2000 | Suga et al. | 271/228 |
| 6,095,515 | A | 8/2000 | Kiyohara et al. | 271/161 |
| 6,131,899 | A | 10/2000 | Nojima et al. | 271/121 |
| 6,200,043 | B1 | 3/2001 | Inoue et al. | 400/88 |
| 6,250,827 | B1 | 6/2001 | Nojima et al. | 400/691 |
| 6,356,735 | B1 * | 3/2002 | Hozumi | 399/395 |
| 6,550,621 | B2 | 4/2003 | Fukatsu et al. | 209/534 |

(Continued)

FOREIGN PATENT DOCUMENTS

| | | |
|---|---|---|
| JP | 9-175694 | 7/1997 |

(Continued)

*Primary Examiner*—Patrick H Mackey
*Assistant Examiner*—Luis Gonzalez
(74) *Attorney, Agent, or Firm*—Fitzpatrick, Cella, Harper & Scinto

(57) ABSTRACT

A sheet conveying apparatus has a skew conveying correction roller pair 2 for conveying a sheet, skew conveying detection sensors 3*a* and 3*b* for respectively detecting a skew of a sheet and a sheet-end-position detection sensor 4 for detecting the side position of the sheet. The skew conveying correction roller pair 2 is skewed by a skew amount obtained by adding a first skew amount for correcting the skew of a sheet detected by the skew conveying detection sensor 3*a* and 3*b* and a second skew amount $\theta_2$ for correcting the side position of a sheet detected by the sheet-end-position detection sensor 4. After the sheet is nipped by the skew conveying correction roller pair 2, the skew conveying correction roller pair 2 is skewed by the first skew amount $\theta_1$.

7 Claims, 12 Drawing Sheets

U.S. PATENT DOCUMENTS

| | | | | |
|---|---|---|---|---|
| 6,739,590 | B2 * | 5/2004 | Otsuka | 271/227 |
| 7,088,948 | B2 * | 8/2006 | Puckett et al. | 399/395 |
| 2002/0145249 | A1 * | 10/2002 | Acquaviva et al. | 271/228 |
| 2003/0057637 | A1 * | 3/2003 | Kawamura et al. | 271/227 |
| 2005/0035536 | A1 | 2/2005 | Suga et al. | 271/226 |
| 2006/0017214 | A1 | 1/2006 | Inoue | 271/10.12 |

FOREIGN PATENT DOCUMENTS

| | | |
|---|---|---|
| JP | 10-67448 | 3/1998 |
| JP | 2001-273538 | 10/2001 |

* cited by examiner $\theta_1 = \tan^{-1}(\Delta t \times V_1 / L)$ $V_2 = V_1 / \cos\theta_2$ $e_1 = e_0 / \cos\theta_1$ $e_2 = e_1 - X\tan\theta_2$ $\theta_2 = \tan^{-1}((e_2 - e_0/\cos\theta_1)/X)$

SHEET CONVEYING APPARATUS, IMAGE FORMING APPARATUS AND IMAGE READING APPARATUS

BACKGROUND OF THE INVENTION

1. Field of the Invention

The present invention relates to a sheet conveying apparatus, an image forming apparatus and an image reading apparatus.

2. Related Background Art

Some of sheet conveying apparatuses for conveying sheets are respectively provided with skew conveying correction means which is means for correcting skew conveying correction and position deviation of a sheet.

A sheet conveying apparatus is provided for image formation and image reading of a copying machine, printer, facsimile or scanner. Skew conveying correction means is used immediately before an image forming portion or image reading portion to adjust the attitude and position of a sheet.

In this case, as a system of the skew conveying correction means, there is a loop forming system for forming a loop on a sheet by running a front end of a sheet against a nip of a stopped roller pair. In the case of the sheet whose front end is run against the roller pair, the skew conveying is corrected because the front end of the sheet goes along the nip of the roller pair.

However, the above loop forming system requires a loop space for forming a loop and an apparatus is increased in size.

When the loop space cannot be sufficiently secured, there is a problem that jam due to buckling occurs in weak-kneed thin paper.

There is a problem that sound occurs when bringing a sheet into contact with a roller pair.

There is a problem that a skew conveying correction capacity is changed due to the strength of the knee of a sheet. In the case of thin paper having no knee of sheet, the contact pressure when the front end of the sheet contacts with the nip of a roller pair becomes insufficient and thereby the front end of the sheet may not sufficiently contact with a resist roller pair. In this case, skew conveying correction cannot be completely made. However, in the case of thick paper having strong knee of sheet, a trouble may occur that the paper penetrates the nip of the roller pair due to an impact when the paper contacts with the nip portion of the roller pair.

Moreover, when there is a curl or broken portion on the front end of a sheet, the front end of the sheet does not accurately follow the nip portion of a roller pair and a case occurs in which skew conveying correction cannot be accurately made. Therefore, this is not sufficiently satisfied as a printing accuracy.

Furthermore, a substantial image forming rate is improved without raising a process speed for image formation in the case of image formation by decreasing the interval between sheets (sheet interval) and processing many sheets in a short time because an image forming apparatus and image reading apparatus are recently digitized.

In the case of the previously-described loop forming system, it is necessary to once stop a sheet to form a loop. Therefore, the interval between sheets (sheet interval) is inevitably decided and it is greatly impeded that the productivity of substantial sheet conveying is improved.

A sheet conveying apparatus is proposed which makes it possible to automatically cure a skew of a sheet due to skew conveying of the sheet (refer to Japanese Patent Application Laid-Open Nos. H10-067448 and 2001-273538).

The apparatus disclosed in Japanese Patent Application Laid-Open No. H10-067448 is provided with a conveying roller pair (skew conveying correction rollers) for nipping and conveying a sheet and a skew-amount detecting sensor for detecting a skew amount of a sheet set at the downstream side in the conveying direction of the conveying rollers. The skew conveying of the sheet is corrected by displacing the conveying rollers in accordance with the skew of the sheet in accordance with the information of the sheet-skew-amount detecting sensor.

In the case of this sheet conveying apparatus, however, conveying rollers are skewed from the original sheet conveying direction when the skew conveying correction of the sheet is performed as described above. Therefore, when conveying a sheet under this state, the sheet is conveyed in a direction skewed from the original sheet conveying direction (hereafter referred to as skew feeding). In this case, when applying the sheet conveying apparatus to an image forming apparatus, an image is transferred by being shifted from the sheet by an amount for performing skew feeding in the direction orthogonal to the sheet conveying direction and there is a trouble that a printing accuracy is extremely deteriorated.

To correspond to the trouble of skew feeding, in the case of Japanese Patent Application Laid-Open No. H10-067448, a sensor for detecting the position of an end of a sheet in the direction orthogonal to the sheet conveying direction at the side end of the sheet is set to the downstream side of conveying rollers. Moreover, a conveying roller pair is moved in the direction orthogonal to the sheet conveying direction to correct a position in accordance with a detection result by a sheet-end-position detecting sensor.

Furthermore, in the case of the bill processor disclosed in Japanese Patent Application Laid-Open No. 2001-273538, two sets of correction roller pairs to be pivotally moved about a pivotal movement axis extended in the face direction of a bill conveyed along a conveying route are set. By pivotally moving and skewing the upstream-side correction roller pair and skew-feeding a bill by the upstream-side correction roller pair, a displacement in the width direction intersecting with the conveying direction of the bill is corrected. Thereafter, the bill is held by the-downstream-side correction roller pair and then, the skew (angular shift) of the bill is corrected by skewing the downstream-side roller pair.

When using a skew correcting mechanism for displacing a conveying roller pair so as to skew it from the direction orthogonal to a sheet conveying direction and a position correcting mechanism for moving the conveying roller pair in the direction orthogonal to the sheet conveying direction like the configuration disclosed in Japanese Patent Application Laid-Open No. H10-067448, an apparatus is increased in size and the cost is increased. Sufficient time is necessary in order to perform a series of correcting operations because positional correction in the direction orthogonal to the sheet conveying direction is performed. Therefore, it is difficult to increase the conveying speed of a sheet in conveying rollers in order to increase the productivity of sheet conveying.

Moreover, the configuration disclosed in Japanese Patent Application Laid-Open No. 2001-273538 skews a correction roller pair at downstream side after nipping a bill by the downstream-side correction roller pair. The bill is skew-fed by the downstream-side correction rollers and a displacement in the width direction occurs. Moreover, it is necessary to use two sets of correction roller pairs which pivotally move about the pivotal movement axis extend in the face direction of the bill and an apparatus is increased in size and the cost is increased.

SUMMARY OF THE INVENTION

The present invention is made in view of the above situation and its object is to provide a low-cost compact sheet conveying apparatus capable of raising the conveying speed of a sheet.

To solve the above problem, a sheet conveying apparatus of the present invention has a skew correction roller for conveying a sheet by nipping the sheet and capable of pivotally moving to correct the skew of the sheet, a sheet position detection means for detecting the skew of a sheet and a sheet position in a direction intersecting with a sheet conveying direction before a sheet is nipped by the skew correction roller and control means for controlling pivotal moving of the skew correction roller, wherein the control means so controls the pivotal movement of the skew correction roller that the skew correction roller is pivotally moved by a skew amount obtained by adding a first skew amount for correcting the skew of a sheet detected by the sheet position detection means and a second skew amount for correcting a sheet position in a direction intersecting with the sheet conveying direction detected by the sheet position detection means before the sheet is nipped by the skew correction roller and the skew correction roller is pivotally moved by the first skew amount in the direction opposite to the direction in which the sheet is skewed detected by the sheet position detection means after the sheet is nipped by the skew correction roller.

DESCRIPTION OF THE PREFERRED EMBODIMENTS

Embodiments of the present invention are described below by referring to the accompanying drawings.

Figure 1:
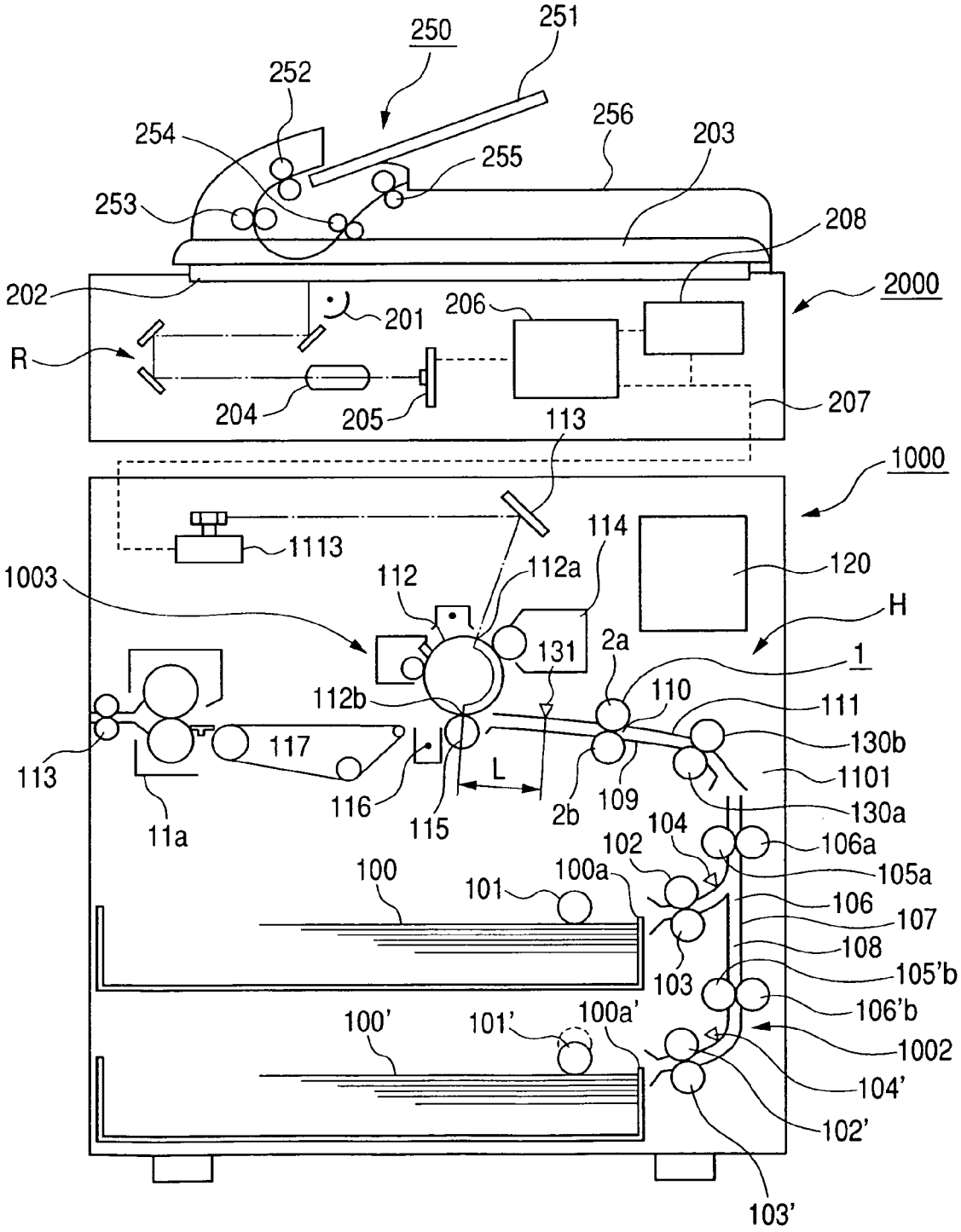
FIG. 1 is a sectional view of a printer which is an example of an image forming apparatus provided with a sheet conveying apparatus of the present invention.

FIG. 1 is a sectional view of a printer which is an example of an image forming apparatus provided with a sheet conveying apparatus of first embodiment of the present invention.

In FIG. 1, reference numeral 1000 denotes a printer which is provided with a printer body 1101 and a scanner 2000.

The scanner 2000 is provided with a scanning-optical-system light source 201, original plate 202, make-break original pressing plate 203, lens 204 and light receiving element (photoelectric conversion) 205. Moreover, the scanner 2000 is provided with an image processing portion 206 and a memory portion 208 for storing an image processing signal processed by the image processing portion 206. The scanning-optical-system light source 201, lens 204 and light receiving element (photoelectric conversion) 205 constitute a reading portion R serving as reading means for reading the image of an original.

Furthermore, the scanner 2000 is provided with an original feeding apparatus 250 which comprises an original tray 251, original feeding roller 252, pre-reading conveying roller 253, post-reading conveying roller 254, original discharging roller 255 and original discharging tray 256.

Image information of an original mounted on the original plate 202 is read by a reading portion R and processed by the image processing portion 206. The image information is electrically encoded and converted into an electrical signal 207 by the image processing portion 206 and transmitted to a laser scanner (laser modulation) 1111. Moreover, the image information which is processed and encoded by the image processing portion 206 is once stored in the memory 208 and can be transmitted to the laser scanner 1111 in accordance with a signal from a controller 120 according to necessity.

Moreover, the image of the original mounted on the original tray 251 of the original feeding apparatus 250 is read by the reading portion R while the original is conveyed by the original feeding roller 252, pre-reading conveying roller 253 and post-reading conveying roller 254. The original whose image is read is discharged to the original discharging tray 256 by the original discharging roller 255.

The printer body 1101 is provided with a sheet feeding apparatus 1002 for feeding a sheet S, sheet conveying apparatus H for conveying the sheet S fed by the sheet feeding apparatus 1002 and controller 120 serving as control means for controlling the printer 1000.

The sheet feeding apparatus 1002 is provided with a cassette 100, pickup roller 101 for feeding a sheet in the cassette 100 when the roller 101 rises or lowers and rotates at a predetermined timing, feed roller 102 for separating and feeding sheets fed by the pickup roller 101 one by one and retard roller 103.

The sheet conveying apparatus H is provided with conveying roller pairs 105*a* and 105*b*, skew conveying correction pre-roller pairs 130*a* and 130*b* and skew conveying correction roller pairs (skew correction roller) 2*a* and 2*b*. A sheet conveyed by the sheet conveying apparatus 1002 passes through a conveying route 108 constituted of guide plates 106 and 107. The sheet passing through the conveying route 108 is transferred to a conveying route 110 constituted of guides 109 and 111 and guided to a skew conveying correcting portion 1 by the skew conveying correction roller pair 130. Skew conveying correction and positional correction of a sheet are performed by the skew conveying correcting portion 1 and then, the sheet is conveyed to an image forming portion 1003.

The image forming portion 1003 set to the printer body 1101 is an electrophotographic system. The image forming portion 1003 is provided with a photosensitive drum 112 which is an image bearing member and rotates clockwise, laser scanner 1111 serving as image forming means, developing device 114, transfer roller 115 serving as transfer means and separation charging device 116. A laser beam emitted from the laser scanner 1111 is reflected by a mirror 113 and applied to an exposure position 112*a* on the photosensitive drum 112. A latent image is formed on the photosensitive drum 112 by applying the laser beam and actualized as a toner image by the developing device 114. Moreover, the toner image on the photosensitive drum 112 is transferred to a sheet in the transfer portion 112*b* by the transfer roller 115.

The front end of the sheet S passing through a skew conveying correction roller pair 2 is detected by an exposure start sensor 131 and irradiation of a laser beam is started by the laser scanner 1111.

In the case of this embodiment, the distance $\mathbf{1}_1$ between the exposure start sensor 131 and the transfer portion 112*b* is equal to the distance $\mathbf{1}_0$ between the laser irradiating position 112*a* of the photosensitive drum 112 and the transfer portion 112*b* and thereby, it is possible to synchronize the sheet S with the front end position of an image on the drum 112.

A sheet to which a toner image is transferred is conveyed to a fixing apparatus 118 by a conveying belt 117 and the toner image is fixed by the fixing apparatus 118. Thereafter, the sheet is discharged to the outside of the apparatus by a sheet discharging roller 119.

In the case of this embodiment, an example is described in which the printer body 1101 is separate from the scanner 2000. However, it is allowed that the printer body 1101 is integrated with the scanner 2000. When inputting the information on the image of an original read by the scanner 2000 to the laser scanner 1111 as a processing signal of an image forming portion, the printer body 1101 functions as a copying machine. When inputting a FAX transmission signal to the laser scanner 1111, the printer body 1101 functions as a FAX. Moreover, when inputting an output signal of a personal computer, the printer body 1101 functions as a printer.

However, when transmitting a processing signal of the image processing portion 206 to another FAX, the printer body 1101 functions as a FAX.

Figure 2:
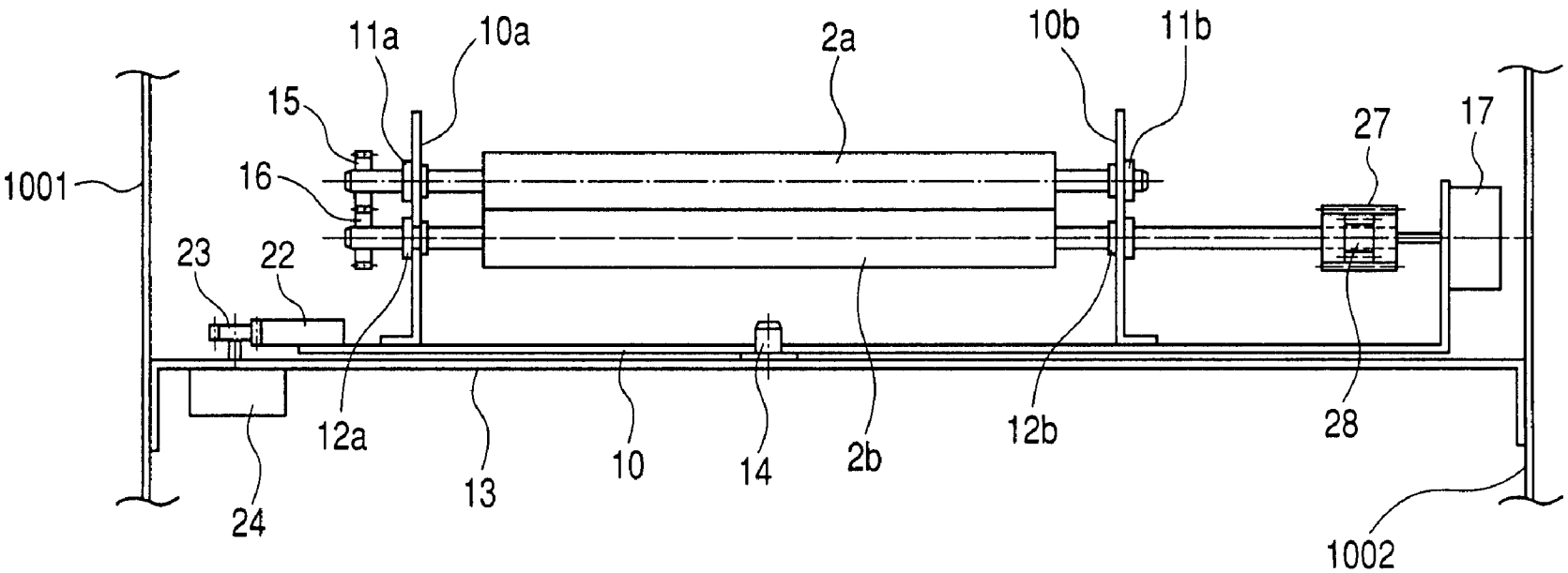
FIG. 2 is a side view of a skew conveying correcting portion of the above sheet conveying apparatus.
Figure 3:
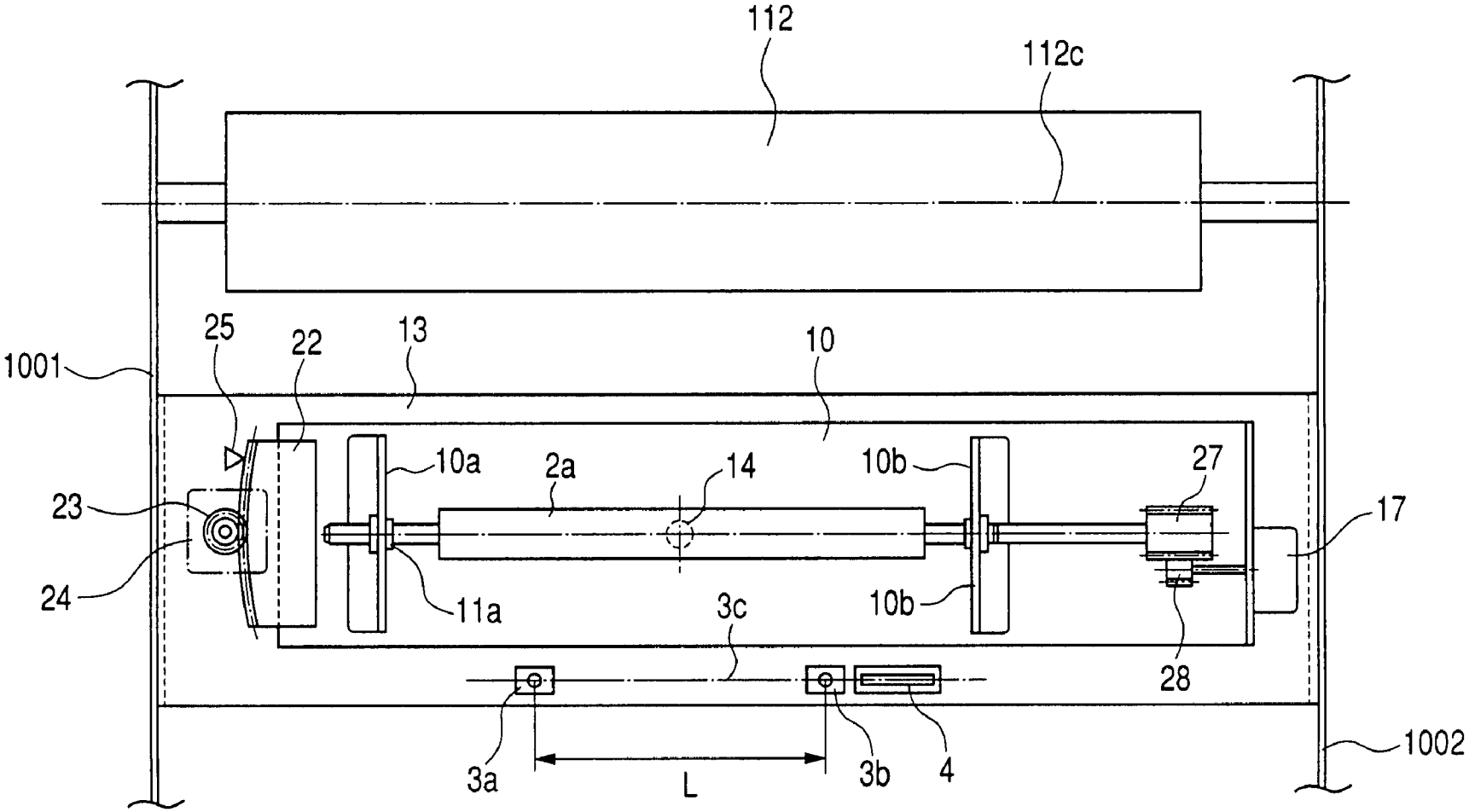
FIG. 3 is a top view of the skew conveying correcting portion of the above sheet conveying apparatus.

FIG. 2 is a side view of the skew conveying correcting portion 1 and FIG. 3 is a top view of it.

As shown in FIGS. 2 and 3, the skew conveying correction roller pair 2 serving as skew correcting means is constituted of two skew conveying correction rollers 2*a* and 2*b*. The pair of skew conveying correction rollers 2*a* and 2*b* conveys a sheet by nipping it. The pair of skew conveying correction rollers 2*a* and 2*b* are rotatably journaled by bearings 11*a* and 11*b* and bearings 2*a* and 12*b* respectively set to side plates 10*a* and 10*b* constituting a frame 10.

The skew conveying correction roller 2*a* is pressed against the skew conveying correction roller 2*b* by a not-illustrated pressure spring. Moreover, gears 15 and 16 are set to either sides of the skew conveying correction roller pair 2*a* and 2*b* so that the skew conveying correction roller pair 2*a* and 2*b* are synchronously rotated.

A driving input gear 27 is fixed to the shaft end of the skew conveying correction roller 2*b* and engaged with a gear 28 fixed to the output shaft of a motor 17. Thereby, the skew conveying correction roller pair 2 is rotated in accordance with driving by the motor 17. Because the skew conveying correction roller pair 2 is rotated in accordance with driving by the motor 17, a sheet nipped by the skew conveying correction roller pair 2 is conveyed.

An almost-horizontally-set stay 13 is fixed to the front side plate 1001 and rear side plate 1002 of the printer body 1101. Moreover, the frame 10 holding the skew conveying correction roller pair 2 is rotatably set to the stay 13 about a pivotally moving shaft 14 set to the stay 13.

The pivotally moving shaft 14 is present at the rotating center when a skew of the skew conveying correction roller pair 2 to be described later is corrected and the shaft line of the pivotally moving shaft 14 is vertical to the shaft line of the skew conveying correction roller pair 2.

A gear 22 is fixed to the front side plate 1001 of the frame 10. The gear 22 is engaged with a rack gear 23 formed on the output shaft of a skew conveying correction motor 24 serving as pivotally moving means set to the stay 13.

When the skew conveying correction motor 24 rotates, the skew conveying collection roller pair 2 rotates. That is, for example, when the skew conveying correction motor 24 rotates clockwise in FIG. 3, the rack gear 23 also rotates clockwise. When the rack gear 23 rotates clockwise, the frame 10 rotates counterclockwise about the pivotally moving shaft 14. The frame 10 holds the skew conveying correction roller pair 2 and motor 17. Therefore, when the frame 10 rotates counterclockwise, all members set to the frame 10 including the skew conveying correction roller pair 2 and motor 17 rotate counterclockwise about the pivotally moving shaft 14. By the above configuration, the skew conveying correction roller pair 2 rotates in the direction for correcting a skew of a nipped sheet in accordance with the pivotal movement of the skew conveying correction motor 24.

When the skew conveying correction motor 24 pivotally moves, a nip line of the skew conveying correction roller pair 2 can displace so as to be skewed. The sheet nipped by the skew conveying correction roller pair 2 substantially pivotally moves in the sheet face in accordance with the pivotal movement of the skew conveying correction roller pair 2.

Moreover, a home position sensor 25 is set on the stay 13. A home position in the pivotally moving direction in which the nip line of the skew conveying correction roller pair 2 becomes parallel with the rotation center shaft 112*c* of the photosensitive drum 112 is detected by the home position sensor 25. The downstream-side conveying portion of the present invention is constituted of the photosensitive drum 112 and transfer roller 115.

As shown by a top view in FIG. 3, a skew conveying detection sensors 3*a* and 3*b* for respectively detecting a skew of a sheet by detecting the front end of the sheet S are arranged in the direction orthogonal to a sheet conveying direction at the upstream side in the conveying direction of the skew conveying correction roller pair 2 by keeping a predetermined interval L. The center line 3*c* for connecting the skew conveying detection sensors 3*a* and 3*b* is set so as to be parallel with the shaft line 112*c* of the photosensitive drum 112 set to the downstream side in the conveying direction.

Moreover, a sheet-end-position detection sensor 4 constituted of a CCD sensor or the like is set to the upstream side in the conveying direction of the skew conveying correction roller pair 2. The sheet-end-position detection sensor 4 detects the position of a sheet in the direction intersecting with a conveying direction by detecting an end of a sheet (hereafter referred to as side of sheet) parallel with the conveying direction of a sheet currently conveyed. Sheet position detection means of the present invention is constituted of the skew conveying detection sensors 3*a* and 3*b* and sheet-end-position detection sensor 4.

Figure 4:
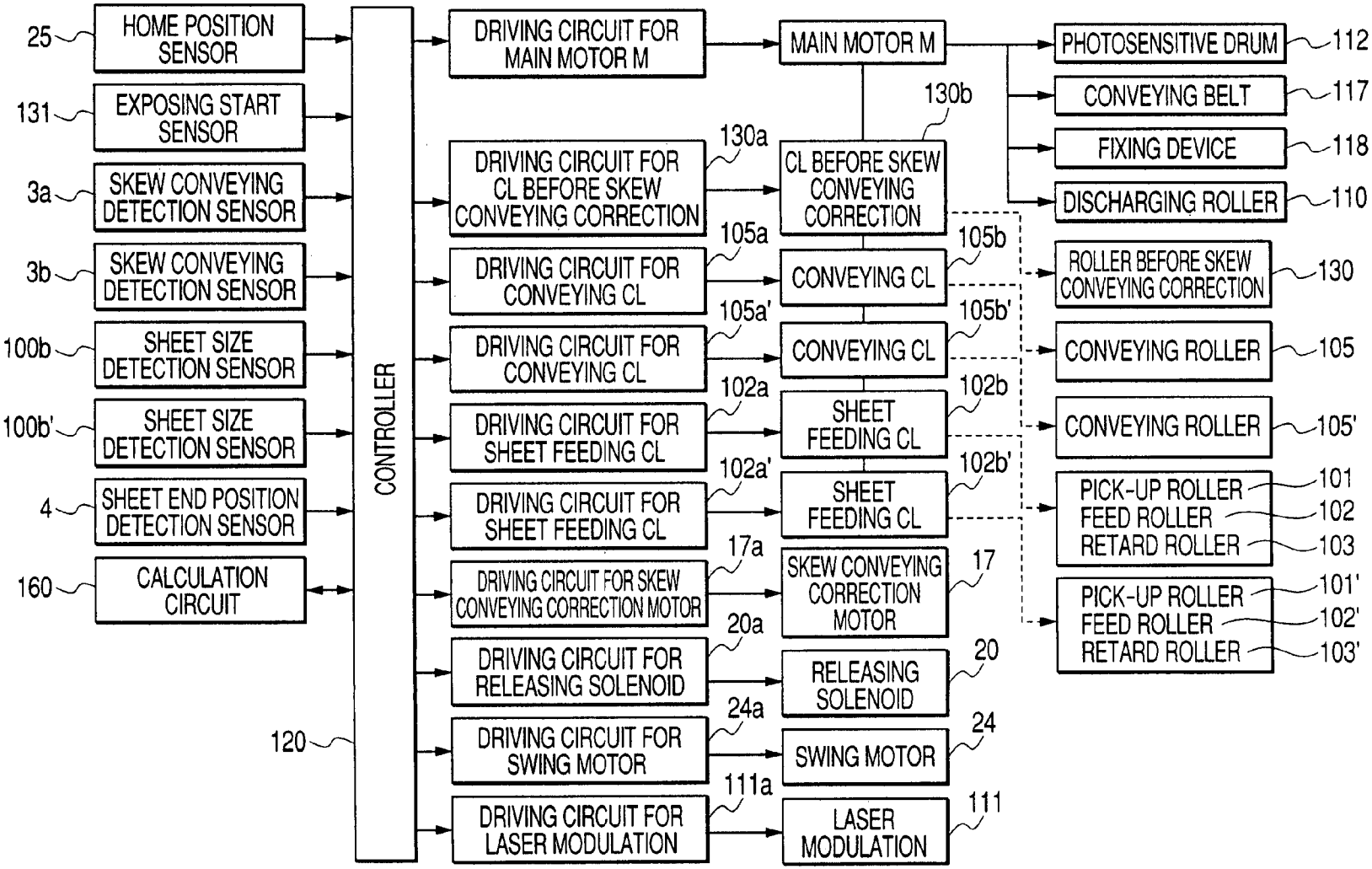
FIG. 4 is a control block diagram of the above printer.

FIG. 4 is a block diagram of the printer 1000 provided with the sheet conveying apparatus H. Each of the above described roller pairs 102, 105 and 130 receives a driving force from a main motor M as shown by the block diagram. The roller pairs 102, 105 and 130 are constituted so as to be turned on/off by clutches 102*b*, 105*b* and 130*b* through driving circuits 102*a*, 105*a* and 130*a*. Moreover, the photosensitive drum 112, conveying belt 117, fixing apparatus 118 and discharging roller 119 are directly connected with the main motor M so that they can rotate synchronously with the main motor M.

Sizes of sheets set in sheet feeding cassettes 100 and 100' are detected by sheet-size detection sensors 100*b* and 100*b*'. The sheet-size detection sensors 100*b* and 100*b*' are connected to a controller 120 and the information on sheet sizes is transferred to the controller 120.

The skew conveying detection sensors 3*a* and 3*b* and sheet-end-position detection sensor 4 are connected to the controller 120 serving as control means. Detection signals obtained from the skew conveying detection sensors 3*a* and 3*b* and sheet-end-position detection sensor 4 are input to the controller 120. In the case of the controller 120, a skew amount of a sheet and a shift amount of a side of the sheet are computed in accordance with detection signals of the sensors by an arithmetic circuit 160. Moreover, the controller 120 is connected to driving circuits 17*a* and 24*a* of the motor 17 and the skew conveying correction motor 24, respectively. The controller 120 outputs necessary control signals according to detection signals to control the motor 17 and skew conveying correction motor 24 so as to drive them.

A releasing solenoid 20 serving as a releasing mechanism for releasing the nip of the skew conveying correction roller pair 2 is used. After the front end of a sheet is conveyed by the photosensitive drum 112 and transfer roller 115, the releasing solenoid 20 releases the nip of the sheet by the skew conveying correction roller pair 2. The releasing solenoid 20 is connected to the controller 120 so that on/off control of the registration releasing solenoid 20 can be performed in accordance with a signal from the controller 120.

Figure 5:
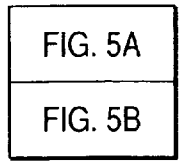
FIG. 5 is comprised of FIGS. 5A and 5B showing flowcharts for explaining the skew conveying correcting operation by the above sheet conveying apparatus.
Figure 5A:
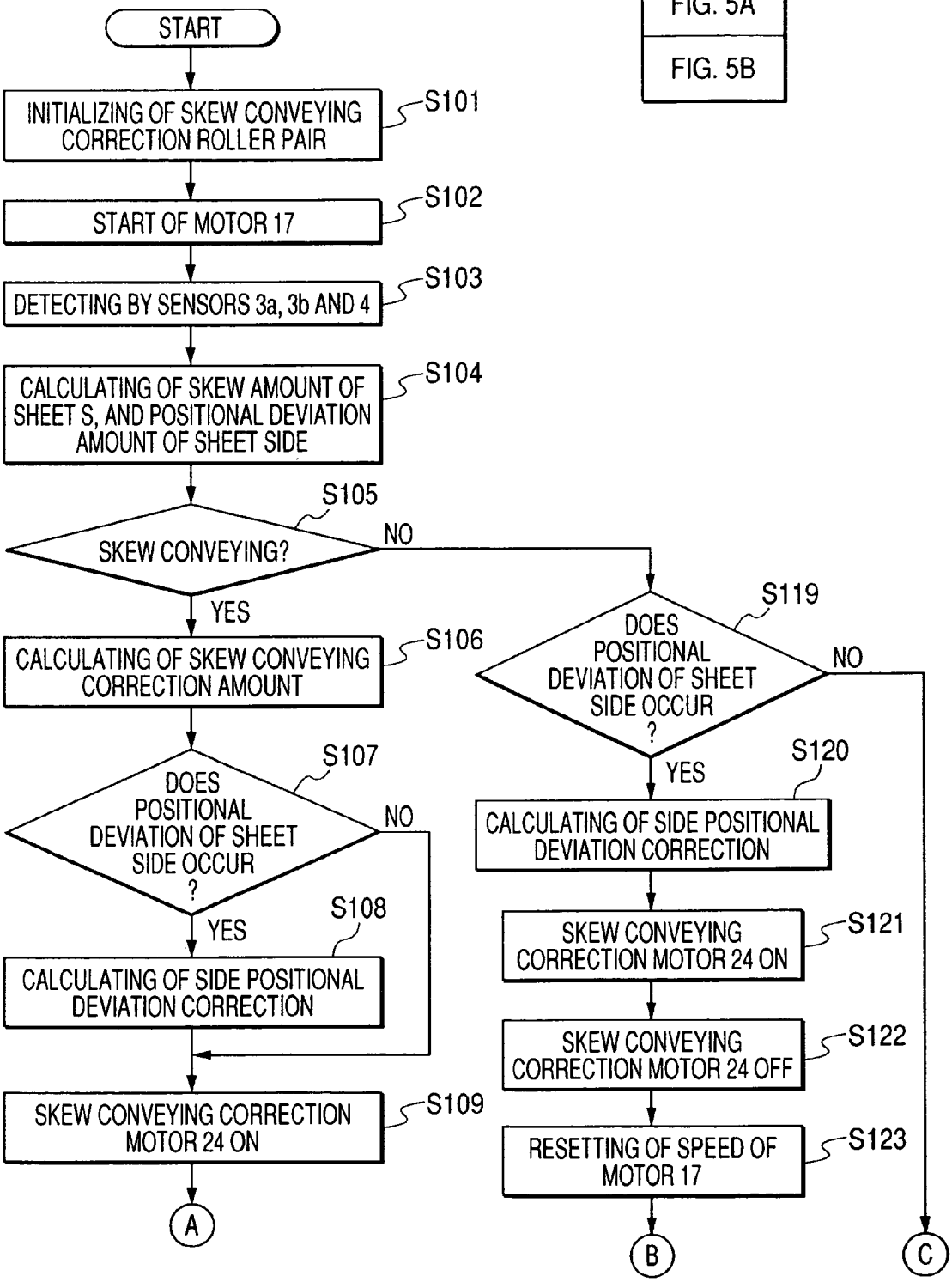
Figure 5B:
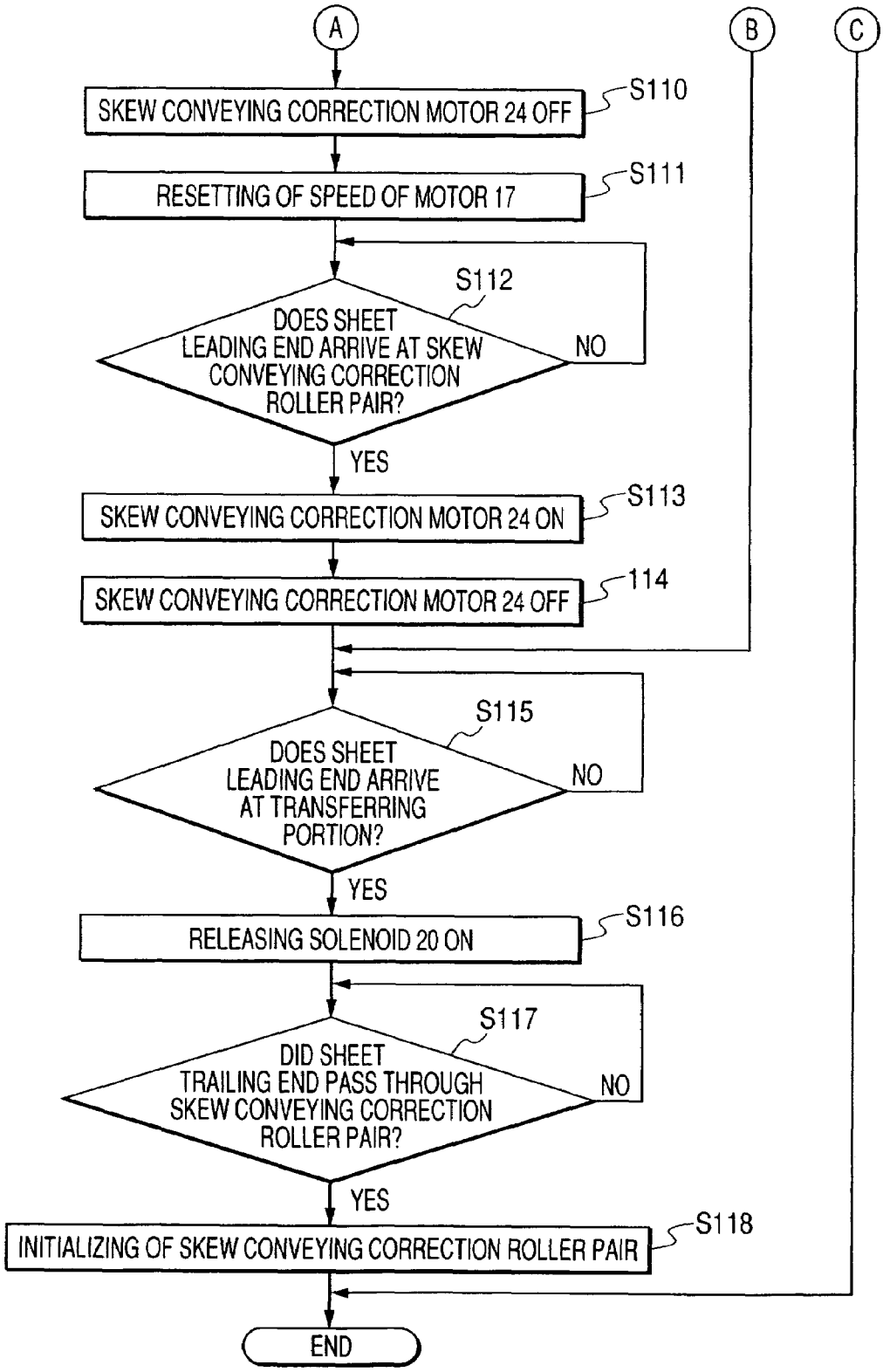

Then, the correcting operation of the sheet conveying apparatus H is described below by referring to the flowchart shown in FIGS. 5A and 5B, top view in FIGS. 6A, 6B, 6C, 6D and 6E, and illustrations for respectively explaining a method for calculating a skew amount and conveying speed of a sheet in FIGS. 7A and 7B to 9.

First, when a not-illustrated start button of the image forming apparatus 1000 is pressed, the skew conveying correction motor 24 operates and initialization in the pivotally moving direction of the skew conveying correction roller pair 2 is performed by the home position sensor 25 (S101).

Figure 6A:
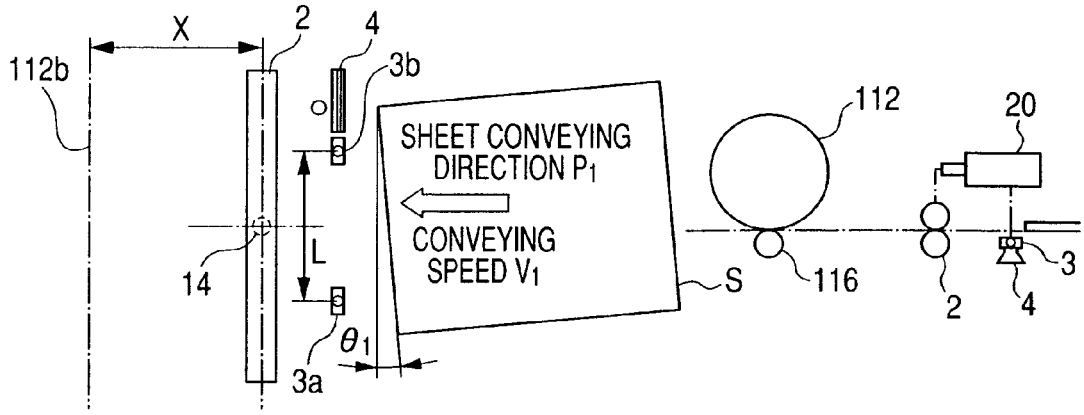
FIGS. 6A, 6B, 6C, 6D and 6E are illustrations for explaining skew conveying correcting operations by the above sheet conveying apparatus.

Then, the motor 17 is driven and rotation of the skew conveying correction roller pair 2 is started (S102). As shown in FIG. 6A, the sheet S whose front end is skewed by $\theta_1$ is sent to the skew conveying correction roller pair 2 in a sheet conveying direction of $P_1$ and at a conveying speed of $V_1$.

Figure 6B:
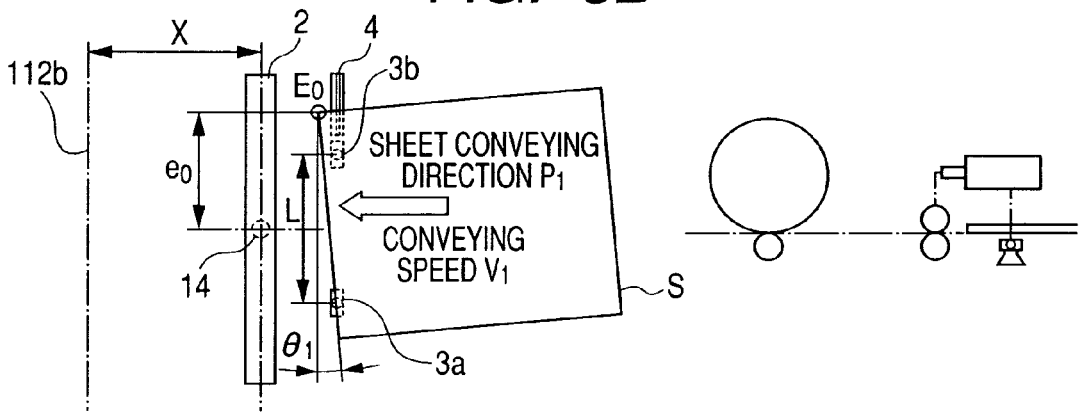

Moreover, as shown in FIG. 6B, when a sheet advances along the sheet conveying direction $P_1$, the passing time of the front end of the sheet is detected by the skew conveying detection sensor 3*a* and 3*b* arranged at the upstream side of the skew conveying correction roller pair 2. Moreover, a sheet end $E_0$ is detected by the sheet-end-position detection sensor 4 (S103).

Detection signals of the skew conveying detection sensors 3*a* and 3*b* and the sheet-end-position detection sensor 4 are input to the controller 120 and the skew $\theta_1$ of the front end of a sheet and the distance $e_0$ up between the pivotally moving shaft 14 and the end of the sheet (hereafter referred to as side of sheet) intersecting with the sheet conveying direction are calculated (S104).

Figure 7A:
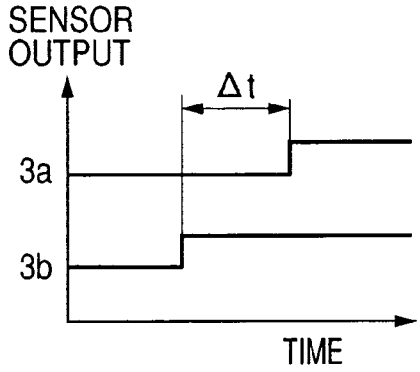
FIGS. 7A and 7B are illustrations for explaining a method for calculating a skew amount of a sheet.
Figure 7B:
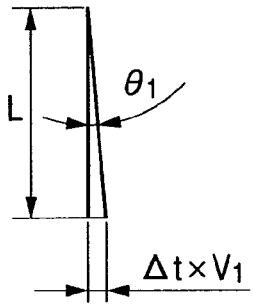

In this case, as shown in FIG. 7A, the skew $\theta_1$ of the sheet S is calculated from the difference between sheet detection times of the skew conveying detection sensors 3*a* and 3*b*. That is, when detection timings by the skew conveying detection sensors 3*a* and 3*b* are detected with a time difference Δt, the skew $\theta_1$ of the sheet can be computed in accordance with the following arithmetic expression (1) by assuming the conveying speed of the sheet S as $V_1$ and pitch (distance between sensors) between the skew conveying detection sensors 3*a* and 3*b* as L as shown in FIG. 7B.

$$\theta_1=\tan^{-1}(\Delta t\times V_1/L) \quad \text{(Expression 1)}$$

The controller 120 determines whether there is a skew detected by the skew conveying detection sensor 3*a* or 3*b* (S105). When there is not a skew of the sheet (when θ=0), correcting operation is not executed. When there is a skew of the sheet, a correction amount for the skew of the sheet (that is, driving amount of the skew conveying correction motor 24 or first skew amount $\theta_1$ of skew conveying correction roller pair 2) is calculated (S106).

Moreover, the controller 120 determines whether it is necessary to correct a shift of the side position of the sheet detected by the sheet-end-position detection sensor 4 (S107). When it is not necessary to correct a shift of the side position of the sheet, a correction amount is not calculated. When it is necessary to correct a shift of the side position of the sheet, a correction amount for the shift of the side position of the sheet to be described later (that is, driving amount of the skew conveying correction motor 24 or the second skew amount $\theta_2$ of the skew conveying correction roller pair 2) is calculated (S108).

Figure 6C:
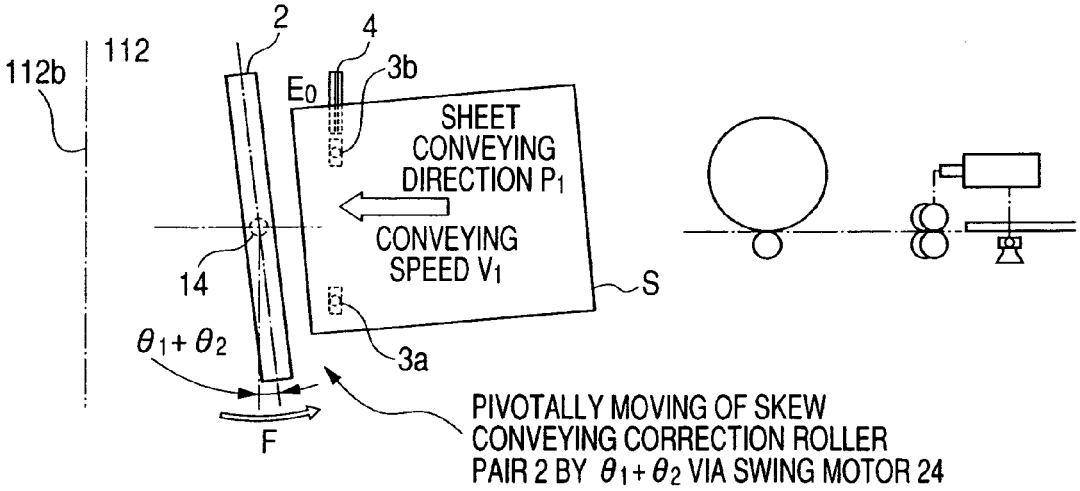

Then, before the sheet is nipped by the skew conveying correction roller pair 2, the skew conveying correction motor 24 is driven so that the skew conveying correction roller pair 2 rotates by a skew amount obtained by adding a skew amount $\theta_2$ corresponding to the side positional shift of the sheet to the skew amount $\theta_1$ corresponding to the detected sheet skew. That is, as shown in FIG. 6C, the operation is performed in which the skew conveying correction roller pair 2 is skewed in the direction of the arrow F by a skew amount obtained by adding the first skew amount $\theta_1$ and the second skew amount $\theta_2$ about the pivotally moving shaft 14 (S109 and S110). The first skew amount $\theta_1$ is the skew conveying amount of the front end of the sheet detected by the skew conveying detection sensor 3*a* and 3*b*. The second skew amount $\theta_2$ will be described later in detail.

The sheet S whose front end is skew-conveyed by $\theta_1$ is sent in the sheet conveying direction $P_1$ at the conveying speed $V_1$ and enters the nip portion of the skew conveying correction roller pair 2 skewed by the skew amount obtained by adding the first skew amount $\theta_1$ and the second skew amount $\theta_2$ and is nipped (S112).

Figure 6D:
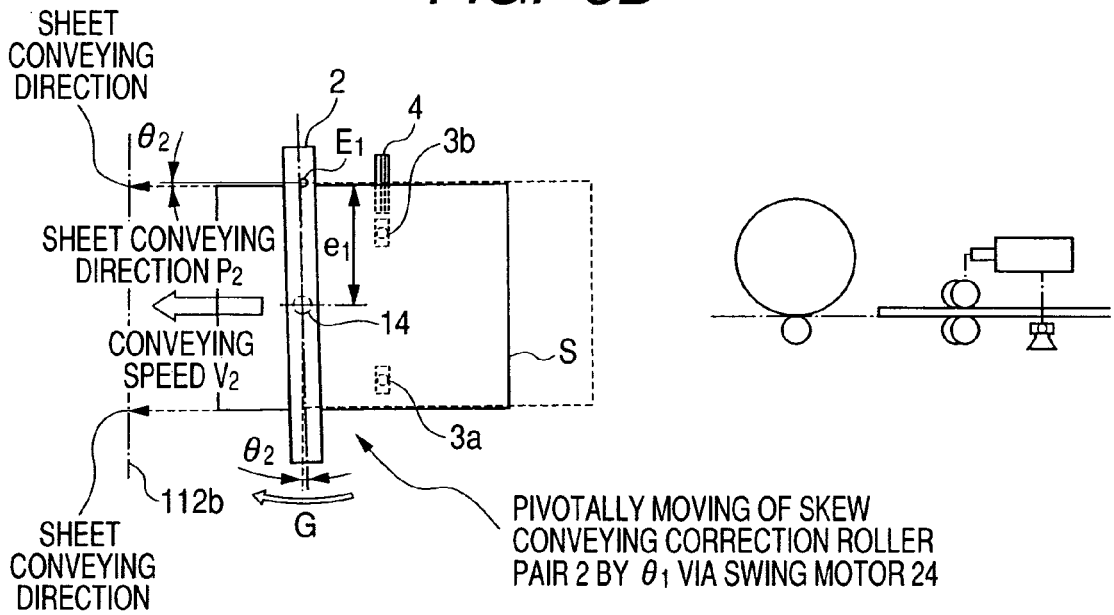

After the sheet is nipped by the skew conveying correction roller pair 2, the skew conveying correction roller pair 2 drives the skew conveying correction motor 24 so as to rotate in the direction opposite to the skew direction of the skew amount $\theta_1$ by the skew amount $\theta_1$ of the sheet S as shown in FIG. 6D. That is, the skew conveying correction roller pair 2 pivotally moves by a pivotally-moving angle $\theta_1$ in the direction of the arrow G about the pivotally moving shaft 14. When the skew conveying correction roller pair 2 pivotally moves in the direction opposite to the skew direction of the sheet S by the skew amount $\theta_1$, the front end of the sheet S nipped by the skew conveying correction roller pair 2 becomes parallel with the shaft direction (shaft direction of photosensitive drum in transfer portion) of the transfer portion 112*b*. The skew conveying of the sheet S is corrected in accordance with the above operation (S103 and S104).

Figure 8:
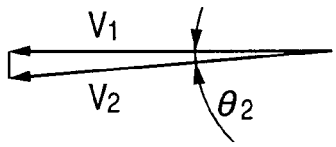
FIG. 8 is an illustration for explaining a method for deciding a conveying speed of a sheet.
Figure 9:
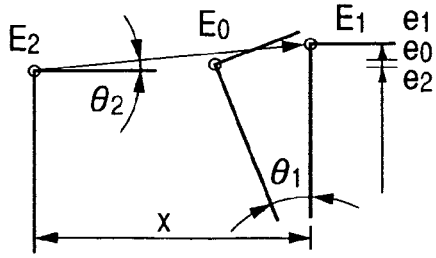
FIG. 9 is an illustration for explaining a method for calculating a skew amount of a skew conveying correction roller pair for adjusting the position of a side of a sheet.

After the pivotal movement of the skew conveying collection roller pair 2 is completed, the actual conveying direction $P_2$ of the sheet S is skewed by the skew amount $\theta_2$ with respect to the original conveying direction $P_1$ (FIG. 6D). Therefore, the whole sheet is conveyed in the diagonal direction at the skewed angle $\theta_2$ (hereafter referred to as skew feeding). Corner portions of the front end of the sheet pass on the chain line in FIG. 6D and the sheet is conveyed to the transfer position 112*b*. Therefore, as shown in FIG. 8, it is necessary to reset the conveying speed of the skew conveying correction roller pair 2 from $V_1$ to $V_2$ in accordance with the following arithmetic expression (2) before the skew conveying correction roller pair 2 nips the sheet S (S111).

$$V_2=V_1/\cos\theta_1 \quad \text{(Expression 2)}$$

Figure 6E:
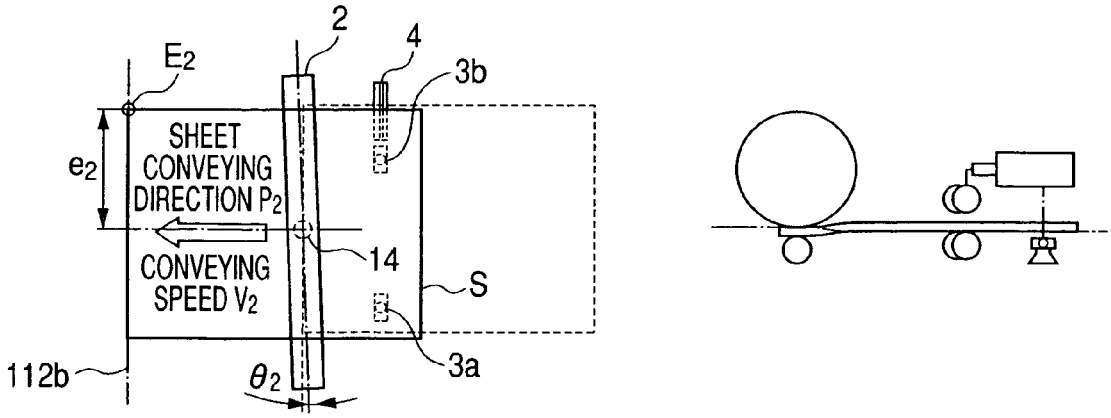

In this case, the state in FIG. 6D is changed to the state in FIG. 6E. During a series of operations, the end of the sheet S moves from $E_0$ through $E_1$ to $E_2$. $E_0$ shows the position of the sheet end before skew-conveying-corrected. $E_1$ shows the position of the sheet end after skew-conveying-corrected. $E_2$ shows the sheet end position (position when sheet end reaches transfer position or a target end position) after the sheet end position is corrected.

Moreover, distances between the pivotally moving shaft 14 and the sheet end in the direction intersecting with the sheet conveying direction $P_1$ at sheet ends $E_0$, $E_1$ and $E_2$ of the sheet S are assumed as $e_0$, $e_1$ and $e_2$. In the case of this embodiment, the sheet side positional shift amount detected by the sheet-end-position detection means 4 is $e_2$-$e_0$. When the skew conveying correction roller pair 2 rotates by $\theta_1$ and the sheet end of the sheet S moves from $E_0$ to $E_1$, this can be shown by the following expression.

$$e_1=e_0/\cos\theta_1 \quad \text{(Expression 3)}$$

When the sheet S is conveyed from the skew conveying correction roller pair 2 up to the transfer portion 112*b* separate from the roller pair 2 by a distance X while it is skewed by $\theta_2$ by the skew conveying correction roller pair 2 and the sheet end of the sheet S moves from $E_1$ to $E_2$, this is shown by the following expression.

$$e_2=e_1-X\tan\theta_2 \quad \text{(Expression 4)}$$

Therefore, to bring the sheet end $E_0$ of the sheet S skew-conveyed by $\theta_1$ in S8 to the sheet end position $E_2$ after correction of the sheet end position, a correction amount to the shift of the side position of the sheet, that is, the driving amount of the skew conveying correction motor 24, that is, the second skew amount $\theta_2$ can be calculated by the following expression.

$$\theta_2=\tan^{-1}((e_0/\cos\theta_1-e_2)/X) \quad \text{(Expression 5)}$$

The sheet S is able to perform skew conveying correction and correct of the positional shift of the side of the sheet.

When it is known that $\theta_1$ is very small, it is also allowed to decide a second correction amount $\theta_2$ by the following expression.

$$\theta_2=\tan^{-1}((e_0-e_2)/X) \quad \text{(Expression 6)}$$

However, it is needless to say that accurate position correction can be made by considering the skew conveying amount $\theta_1$ of the front end of the sheet and thereby calculating the second skew amount $\theta_2$.

As shown in FIG. 6E, when the front end of the sheet S is conveyed to the transfer portion 112*b* (S115), the nip of the skew conveying correction roller pair 2 is released by the registration releasing solenoid 20 (S116).

When the nip of the skew conveying correction roller pair 2 is released by the releasing solenoid 20, the conveying force of the skew conveying correction roller pair 2 is released. Therefore, it is possible to release the stress from the skew conveying correction roller pair 2 to the sheet due to skew feeding of the sheet.

When the above correcting operation is executed, the sheet S is accurately fed and an image is formed while a skew and a positional shift of the side of the sheet are absent for the transfer portion 112*b* which is the nip position between the photosensitive drum 112 serving as second sheet conveying means and the transfer roller.

Moreover, when the rear end of the sheet S escapes from the skew conveying correction roller pair 2 (S117), the initializing operation of the skew conveying correction roller pair 2 is performed (S118) in order to prepare for the next skew conveying and skew conveying correction of the sheet S. The initializing operation is performed in accordance with the home position sensor 25 as previously described.

As described above, the skew of the sheet and the position of the side of the sheet are detected, the skew conveying correction roller pair 2 is previously skewed in accordance with the skew amount of the sheet and the positional shift amount of the side of the sheet, the sheet is nipped by the skew conveying correction roller pair 2 and then the skew conveying correction roller pair 2 is skewed in the opposite direction so that the skew of the detected sheet is eliminated to perform skew conveying correction.

In the sate after skew conveying correction of the front end of the sheet is completed, the skew conveying correction roller pair 2 is skewed by a skew amount corresponding to the positional shift of the side of the sheet. In other words, the skew conveying correction roller pair 2 is skewed in a direction in which the positional shift of the side of the sheet detected by conveying by the skew conveying correction roller pair 2 is eliminated. Therefore, the sheet S is skew-fed by the skewed skew-conveying correction roller pair 2 and thereby, the position of the side of the sheet is corrected.

According to the above configuration, the skew conveying correction and positional shift correction of the side of the sheet can be quickly performed by the conveying by the skew conveying correction roller pair 2 and pivotally moving operation of the skew conveying correction roller pair 2.

It is possible to perform correction only by the skewing operation (pivotally moving operation) of the skew conveying correction roller pair 2 without once stopping the sheet by those operations. Therefore, it is possible to quickly apply the skew conveying correction and positional correction of the side of the sheet to the sheet conveyed at a high speed.

Figure 10A:
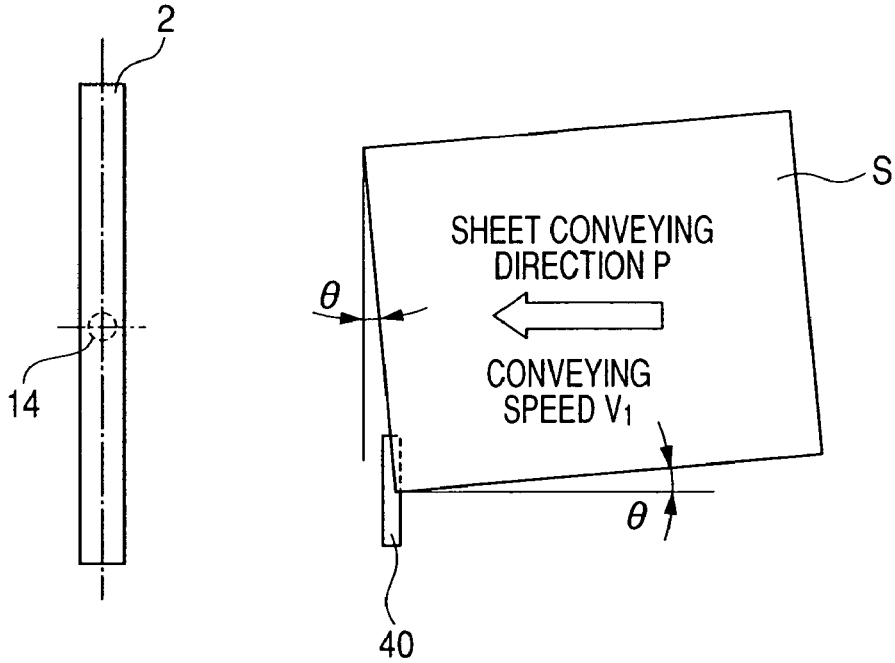
FIGS. 10A and 10B are operational illustrations of a skew conveying correcting portion of an embodiment using another sensor as a sheet position detecting sensor.

Moreover, for the already-described embodiment, a conformation is described in which the skew conveying detection sensors 3*a* and 3*b* are arranged by keeping the predetermined interval L in a direction orthogonal to a sheet conveying direction in order to detect a sheet skew conveying amount. However, it is also allowed to use a CCD sensor in order to detect the sheet skew conveying amount. Hereafter, an embodiment using a CCD sensor is described below by referring to a top view in FIG. 10 in order to detect the sheet skew conveying amount.

As shown in FIG. 10, a sheet-position detection sensor 40 serving as sheet position detection means constituted of a CCD sensor is set to the upstream side in the conveying direction of the skew conveying correction roller pair 2.

The sheet S skewed by θ from the sheet conveying direction P is sent. When the sheet S nipped by the skew conveying correction roller pair 2 is sent along the sheet conveying direction P to advance, the point of time when the front end of the sheet S passes is detected by the sheet position detection sensor 40 set to the upstream side of the skew conveying correction roller pair 2 and the position of the side of the sheet is detected by the sheet position detection sensor 40.

Figure 10B:
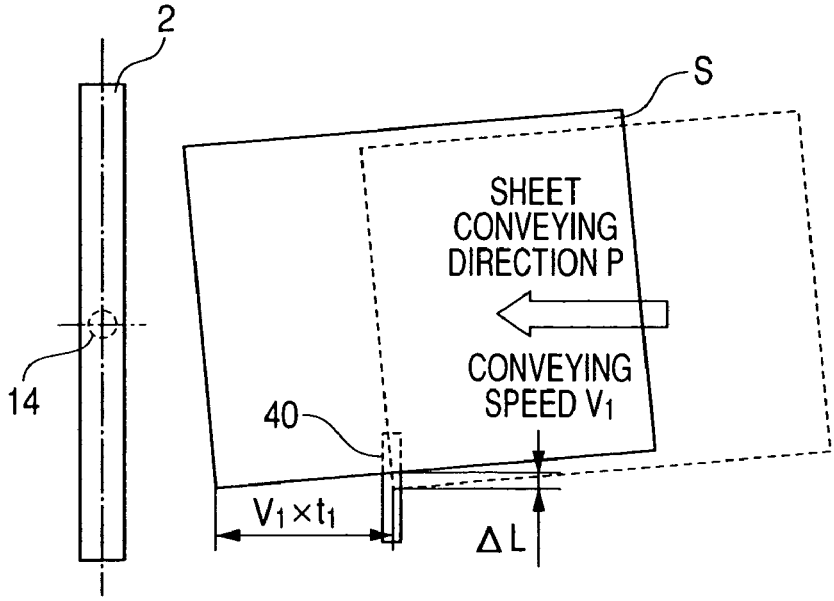
Figure 11:
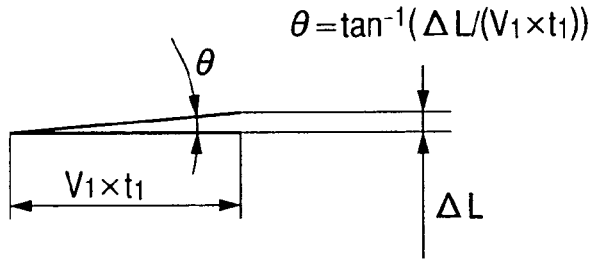
FIG. 11 is an illustration for explaining a method for calculating a skew amount of a sheet.

Then, after predetermined time $t_1$, the sheet position detection sensor 40 detects the position of the sheet again. FIG. 10B shows a state of the sheet after the predetermined time $t_1$ from the state in FIG. 10A. When assuming the difference between amounts at the first time and second time obtained from the sheet position detection sensor 40 as $\Delta L$ and the sheet conveying speed as $V_1$, the skew amount $\theta$ of the sheet can be computed by the following expression as clarified from FIG. 11.

$$\theta=\tan^{-1}(\Delta L/(V_1\times t_1)) \quad \text{(Expression 7)}$$

Thereby, the skew amount $\theta$ of and the positional shift amount of the side of the sheet S can be detected only by the sheet detection sensor 40.

Thus, by detecting the skew conveying amount and the positional shift of the side of the sheet by the sheet position detection sensor 40, it is possible to accurately perform the skew conveying correction and the positional correction of the side of the sheet with a very simple configuration.

For the above embodiment, a configuration is shown in which the pivotally moving center (pivotally moving shaft 14) of the skew conveying correction roller pair 2 is set to almost the central portion of the skew conveying correction roller pair 2 on the shaft line of the skew conveying correction roller pair 2. However, it is allowed to set the pivotally moving center of it to any position. For example, it is allowed to set the pivotally moving center of the skew conveying correction roller pair 2 to one end of the skew conveying correction roller pair 2.

Figure 12A:
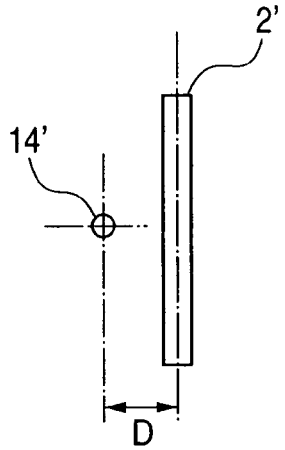
FIGS. 12A and 12B are top views of an embodiment set by shifting the pivotal movement center of a skew conveying correction roller pair.
Figure 12B:
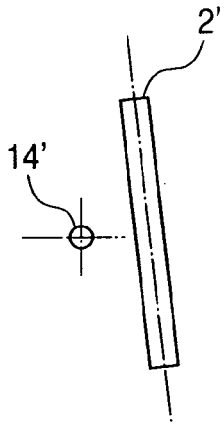

Moreover, it is allowed to set the pivotally moving center of the skew conveying correction roller pair 2 to the downstream side or upstream side in the conveying direction of the skew conveying correction roller pair 2. In this case, it is allowed to calculate the second skew amount $\theta_2$ of the skew conveying correction roller pair 2 corresponding to the positional shift of the side of the sheet from a relation between the position of the side and the position of the pivotally moving center of the sheet detected by the sensor. A method for calculating the second skew amount $\theta_2$ of the skew conveying correction roller pair 2 in a configuration shown in FIGS. 12A and 12B in which a pivotally moving center 14' of a skew conveying correction roller pair 2' is set by separating the center 14' from the roller pair 2' to the conveying-directional downstream side by a distance D will be described while referring to FIG. 13.

Figure 13:
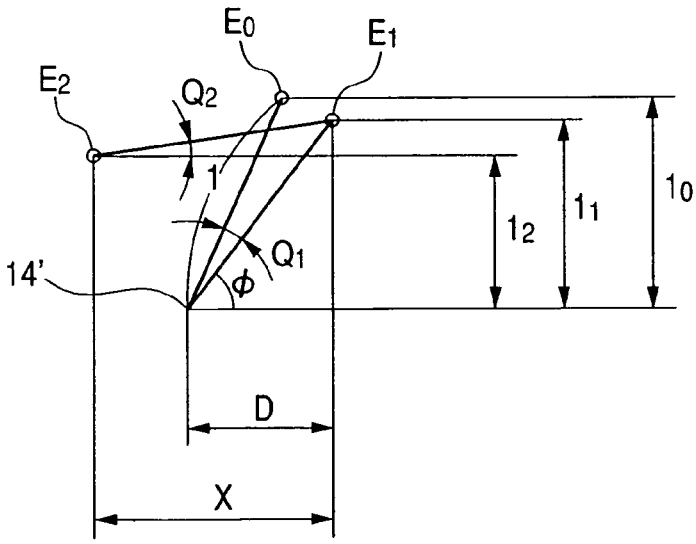
FIG. 13 is an illustration for explaining a method for calculating a skew amount of a skew conveying correction roller pair for adjusting the position of a side of a sheet.

In FIG. 13, $E_0$ shows the position of the side of the sheet before skew conveying correction is made when the front end of the sheet enters the skew conveying correction roller pair 2. $E_1$ shows the position of the side of the sheet after skew conveying correction is made. $E_2$ shows the side position (position when sheet reaches transfer position or side position of purposed sheet) of the sheet after the side position of the sheet is corrected. That is, in FIG. 13, the side of the sheet moves from $E_0$ through $E_1$ to $E_2$. Moreover, distances in the direction intersecting with the conveying direction from the rotating shaft 14' to the sheet end at the side positions $E_0$, $E_1$ and $E_2$ of the sheet S are assumed as $e_0$, $e_1$ and $e_2$. The side positional shift amount of the sheet detected by sheet end position detection means is shown by $e_2$-$e_0$. The following expression is effected in accordance with the relation shown in FIG. 13.

$$l\cdot\cos\phi=D \quad \text{(Expression 8)}$$

$$l\cdot\sin\phi=e_1 \quad \text{(Expression 9)}$$

$$l\cdot\sin(\phi+\theta_1)=e_0 \quad \text{(Expression 10)}$$

By ordering the above three expressions, the following expression is derived as a condition when the skew conveying correction roller pair 2' rotates by $\theta_1$ and the end of the sheet is moved from $E_0$ to $E_1$.

$$e_1=(e_0-D\cdot\sin\theta_1)/\cos\theta_1 \quad \text{(Expression 11)}$$

In this case, the second skew amount $\theta_2$ of the skew conveying correction roller pair 2' corresponding to the positional shift of the side of the sheet is calculated from (Expression 11) and already-described (Expression 4) in accordance with the following expression.

$$\theta_2=\tan^{-1}((e_0D\cdot\sin\theta_1)/\cos\theta_1-e_2)/X) \quad \text{(Expression 12)}$$

For every already-described embodiment, a configuration is described in which immediately after the front end of a sheet enters the skew conveying correction roller pair 2 skewed by a skew amount obtained by adding the first skew amount and the second skew amount, the skew conveying correction roller pair 2 pivotally moves in the direction in which the skew conveying amount of the sheet is corrected by the first skew amount. However, it is also allowed to use a configuration in which after the front end of a sheet enters the skewed skew conveying correction roller pair 2, the sheet is conveyed for a while by the skew conveying correction roller pair 2 and then the skew conveying correction roller pair 2 is pivotally moved in the direction in which the skew conveying of the sheet is corrected by the first skew amount $\theta_1$. In this case, it is needless to say that it is allowed to properly calculate the second skew amount in accordance with a distance for the skew conveying correction roller pair 2 to convey the sheet by the time when the skew conveying correction roller pair 2 is pivotally moved in the direction by $\theta_1$ in which the skew conveying of the sheet is corrected after the front end of the sheet enters the skew conveying correction roller pair 2.

Figure 14:
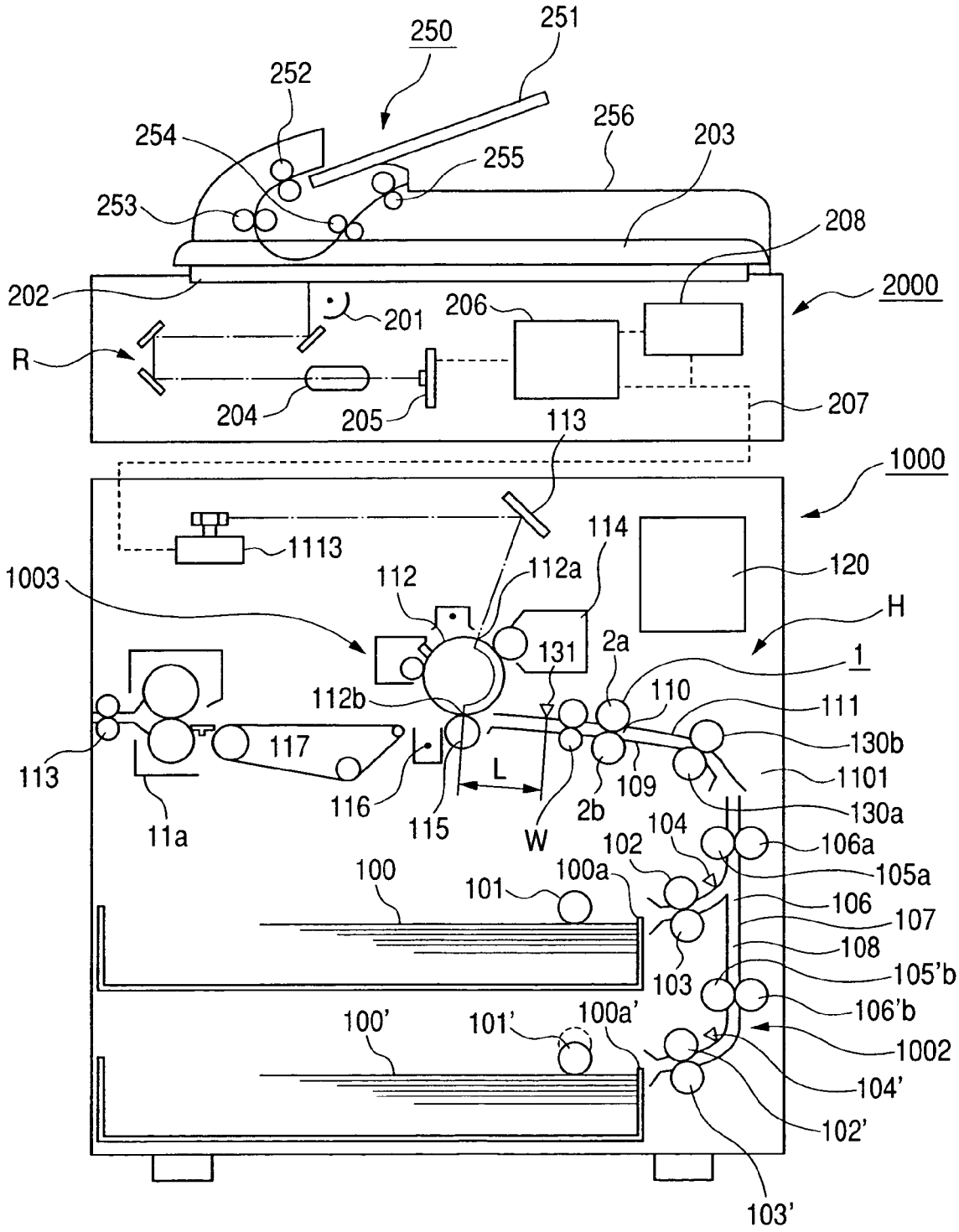
FIG. 14 is a sectional view of an image forming apparatus showing another embodiment.

For every already-described embodiment, an example is shown in which it is made possible to pivotally move the skew conveying correction roller pair 2 conveying synchronously with the image forming portion 1003 to perform skew conveying correction and positional correction of sheet side. However, as long as an apparatus conveys a sheet, it is possible to apply the apparatus to any sheet conveying apparatus. For example, it is allowed to use a conformation in which a rotating member pair W for conveying a sheet is set to the immediately downstream side of a roller pair serving as conveying means for performing skew conveying correction and positional correction of sheet side by pivotally moving (refer to FIG. 14).

For every already-described embodiment, a case is described in which a sheet conveying apparatus is used for an image forming apparatus so that the sheet S can be accurately sent to the image forming portion 1003 with no skew or positional shift. However, the sheet conveying apparatus H can be also applied to an image forming apparatus. For example, it is also allowed to perform skew conveying correction and positional correction of the side of a sheet in accordance with pivotally moving operation by making it possible that the pre-reading conveying roller 253 of the original conveying apparatus 250 set to the scanner 2000 serving as an image reading apparatus is pivotally moved in the direction in which the skew of the sheet is corrected as described above.

According to this embodiment, it is possible to detect the skew of a sheet and the position of the sheet in the direction intersecting with a sheet conveying direction and perform skew conveying correction and positional correction in the direction intersecting with the sheet conveying direction only by the simple operation for skewing a skew conveying collection roller for conveying a sheet. Therefore, it is possible to provide a compact and low-cost sheet conveying apparatus capable of performing high-speed sheet conveying and accurate positional correction.

This application claims priority from Japanese Patent Application No. 2004-211694 filed Jul. 20, 2004, which is hereby incorporated by reference herein.

What is claimed is:

1. A sheet conveying apparatus comprising:

a skew correction roller configured to convey a sheet by nipping the sheet and capable of pivotally moving to correct the skew of the sheet;

a sheet position detection unit configured to detect the skew of a sheet and a shift from a reference position in a direction intersecting with a sheet conveying direction before a sheet is nipped by the skew correction roller; and a controlling unit configured to control pivotal moving of the skew correction roller, wherein the controlling unit so controls the pivotal movement of the skew correction roller that the skew correction roller is pivotally moved by a skew amount obtained by adding a first skew amount for correcting the skew of a sheet and a second skew amount for correcting a sheet position in a direction intersecting with the sheet conveying direction before the sheet is nipped by the skew correction roller and the skew correction roller is pivotally moved by the first skew amount in the direction opposite to the direction in which the sheet is skewed detected by the sheet position detection unit after the sheet is nipped by the skew correction roller for correcting the skew of the sheet, and the first skew amount is an amount for correcting an amount of the skew of a sheet detected by said sheet position detection unit, and the second skew amount is set to an amount for correcting a shift in the direction intersecting with the sheet conveying direction in a case where the skew of a sheet has been corrected and a shift in the direction intersecting with the sheet conveying direction, detected by said sheet position detection unit.

2. The sheet conveying apparatus according to claim 1, further comprising:

a downstream-side conveying member set to the downstream side of the skew correction roller in a sheet conveying direction to convey a sheet; and a releasing mechanism for releasing a conveying force of the skew correction roller, wherein when the sheet conveyed by the skew correction roller is conveyed by the downstream-side conveying member, the conveying force of the skew correction roller is released by the releasing mechanism.

3. The sheet conveying apparatus according to claim 1, wherein the controlling unit changes the conveying speed of a sheet by the skew correction roller correspondingly to the second skew amount.

4. The sheet conveying apparatus according to claim 2, wherein the downstream-side conveying member is constituted of an image bearing member and a transfer member for transferring an image formed on the image bearing member to a sheet.

5. An image forming apparatus comprising:

the sheet conveying apparatus according to claim 1; and an image forming portion for forming an image on the sheet conveyed by the sheet conveying apparatus.

6. An image reading apparatus comprising:

the sheet conveying apparatus according to claim 1; and an image reading apparatus for reading the image of the sheet conveyed by the sheet conveying apparatus.

7. The sheet conveying apparatus according to claim 1, wherein when the sheet reaches a predetermined position in the sheet conveying direction, the shift of the sheet from the reference position in the direction intersecting with the sheet conveying direction is in a corrected situation, by conveyance of the sheet by the skew correction roller with the skew roller being pivotally moved in the direction opposite of the skew direction of the first skew amount by the first skew amount after the sheet is nipped by the skew correction roller.

* * * * *